United States Patent [19]

Plaschnick et al.

[11] 4,410,624

[45] Oct. 18, 1983

[54] METHOD OF DISPERSING OIL SOLUBLE PHOTOGRAPHIC ADDITIVES

[75] Inventors: Dieter Plaschnick, Wolfen; Christoph Roth, Halle-Neustadt; Bernd Noll; Walter Kroha, both of Wolfen; Lothar Kuhnert, Berlin, all of German Democratic Rep.

[73] Assignee: VEB Filmfabrik Wolfen, Wolfen, German Democratic Rep.

[21] Appl. No.: 362,218

[22] Filed: Mar. 26, 1982

[30] Foreign Application Priority Data

Sep. 10, 1981 [DD] German Democratic Rep. ... 230681

[51] Int. Cl.[3] ..... G03C 7/00; G03C 1/40

[52] U.S. Cl. ..... 430/377; 430/385; 430/386; 430/388; 430/449; 430/512; 430/546; 430/553; 430/554; 430/556

[58] Field of Search ..... 430/377, 385, 386, 388, 430/449, 512, 546, 553, 554, 556

[56] References Cited

U.S. PATENT DOCUMENTS

| | | | |
|---|---|---|---|
| 2,353,262 | 7/1944 | Peterson et al. | 430/546 |
| 3,676,141 | 7/1972 | Hara et al. | 430/377 |
| 3,963,499 | 6/1976 | Shiba et al. | 430/546 |
| 3,996,054 | 12/1976 | Santemma et al. | 430/377 |
| 4,207,393 | 6/1980 | Synder | 430/546 |
| 4,284,709 | 8/1981 | Tomka | 430/377 |

*Primary Examiner*—J. Travis Brown

*Attorney, Agent, or Firm*—Jordan and Hamburg

[57] ABSTRACT

The invention relates to a process of dispersing oil-soluble photographic additives having a silver-halide base for information recording materials.

According to the invention, compounds of the following general formula:

are used as auxiliary dispersing agents.

The symbols

R represents hydrogen, alkyl with 1 to 8 C atoms,

M represents hydrogen, alkali metal, ammonium, and

X represents OR or $SO_3M$.

24 Claims, No Drawings

METHOD OF DISPERSING OIL SOLUBLE PHOTOGRAPHIC ADDITIVES

BACKGROUND OF THE INVENTION AND PRIOR ART STATEMENT

This invention relates to a process of dispersing oil soluble photograhic additives having a silver halide base, for information recording materials.

Processes of dispersing photographic additives as an alternative for introduction into silver halide materials have been found to be especially suitable for dye couplers.

In relation to the technology to be used for producing the dispersant particles herein, many processes that vary vastly among themselves may be used, such as, for example, the rotor-stator principle or the propulsion system at increased pressure. Although the preparations of dispersants have been technologically solved to a very large extent, now, as before, further investigations are necessary to stabilize the manufactured dispersant particles through the selection of appropriate high-boiling agents, auxiliary solvents and, above all, of operable surfactants and auxiliary dispersing agents, in order to prevent agglomeration and coalescence, which lead to undesirable clouding in the photographic layers.

Certain compounds, such as acid amides (aliphatic and cyclic), phthalic acid ester and phosphoric ester derivatives have been found to be effective. Their object is especially to ensure good solubility of the dye couplers and to prevent crystallization manifestations since clouding will thereby result in view of a change in the refraction coefficient. In order to facilitate solubility of the couplers in the high-boiling agents, low-boiling auxiliary solvents are most often used, which then are removed from the dispersants, for instance under reduced pressure.

The dispersing process may occur in an aqueous solution or in solutions of protective colloids. Gelatin is preferably used as the protective colloid.

The use of auxiliary dispersing agents is of absolute necessity to facilitate the dispersing process, but, above all, to stabilize the particles produced, the diameters of which, as a rule, lie between 0.1 and 0.4 μm.

High standards are set for these compounds. Thus, they should stabilize the dispersing process, stabilize the particles over several weeks, exercise no photographic activity and not intrude on the coating process on production of the photographic materials. The manifold requirements are not fulfilled by most known auxiliary dispersing agents.

An overview of the auxiliary dispersing agents is, for instance, given by Gawalek in "Tensides"(Akademie Verlag Berlin 1975).

The patent literature has proposed a variety of compounds, such as, for instance, fluorine-containing surfactants in DE-OS No. 2 619 248. DE-OS No. 2 136 492, DE-OS No. 2 129 648 and DE-OS No. 2 045 464 describe anionic surfactants. These surfactants may also be used in mixtures (DE-OS No. 2 448 597). Mixtures of ionic and nonionic surfactants have been described in JP-AS No. 53-48 734, 76-25 133, DE-OS No. 1 942 873, and U.S. Pat. No. 3,676,141, wherein the nonionic surfactant is often used to advantage in the organic phase. However, polymers with surface-active qualities have also been proposed (DE-OS No. 2 820 092).

Dispersing processes for oil-soluble photographic additives which are carried out with the utilization of these compounds have definite disadvantages. Thus, most of the known auxiliary dispersing agents exhibit only inadequate stabilization effect of the dispersants, which very quickly causes enlargement of the particles with the consequent formation of cloudy layers.

DETAILED DESCRIPTION OF PREFERRED EMBODIMENT

Others are photographically active and damage the silver-halide containing layers.

One great disadvantage of almost all auxiliary dispersing agents described is that they desorb from the dispersing particle and actively affect the boundary surfaces of the layers on casting, whereby the casting of multiple layers is disturbed.

It is the object of the invention to find an improved method for dispersing oil-soluble photographic additives so that stable dispersants may be obtained.

It is the object of this invention to find new auxiliary dispersing agents for dispersing oil-soluble photographic additives which facilitate the dispersing process, while stabilizing the produced particles for a longer period of time, without the qualities of the limiting surfaces of the photographic layers being disturbed herein on casting through a desorption of the dispersant particle.

In accordance with this invention, this object is accomplished by carrying out the dispersion of oil-soluble photographic additives in aqueous gelatin or other hydrophilic binding agents as auxiliary dispersing agents, in the presence of compounds of the general formula

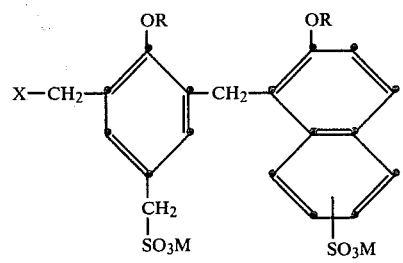

wherein

R represents hydrogen, alkyl with 1 to 8 C atoms,

M represents hydrogen, alkali metals, ammonium, and

X represents OR or $SO_3M$.

As in known processes, dispersion may be carried out in aqueous solutions with differing protective colloids. Known high-boiling and low-boiling solvents are used in the methods of dispersion. The auxiliary dispersing agents of this invention are used in a quantity of 1–30%, preferably 5–15%, in relationship to the additive to be dispersed, in the aqueous phase. The sodium salts of the compounds are advantageously used herein. In a preferred embodiment of the invention, also other surfactants may also be used, wherein greater advantage will be derived from their utilization in the organic phase.

The advantage of the process of this invention is that very reduced quantities of the auxiliary dispersing agents of the present invention will already trigger a smooth dispersion without froth formation and an extremely high increase in viscosity, if gelatin is used as a protective colloid. The dispersants obtained exhibit good storing stability. Coalescence manifestations, and a clouding of the layer thereby, will not occur, even over a longer period of time. If gelatin is used as a protective colloid, then the meltability of the dispersants will also be retained over such period of time, which often is not the case when other surfactants are used. On production of coloring materials with multiple layers, multiple casting may be effected without disturbances, which represents a substantial advantage of the process of the invention.

The process is suitable for dispersing all oil-soluble photograhic additives, for instance dye couplers, uncolored couplers, masking compounds, dye stuffs, stabilizers UV-absorbing agents, optical brighteners, and the like.

Examples of Embodiment

The auxiliary dispersing agents used in the examples have been summarized in Table 1, while suitable, oil-soluble photographic additives have been listed in Table 2.

TABLE 1

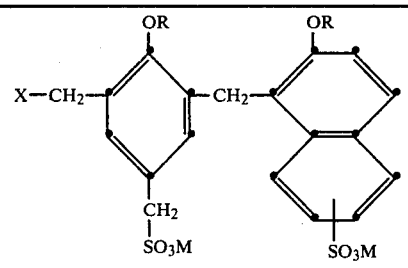

| Auxiliary dispersing agent No. | X | R | M |
|---|---|---|---|
| N 1 | —OH | —H | Na |
| N 2 | —OCH3 | —CH3 | Na |
| N 3 | —OH | —H | K |
| N 4 | —OH | —H | NH4 |

TABLE 2

| Dye Coupler No. | |
|---|---|
| F 1 | 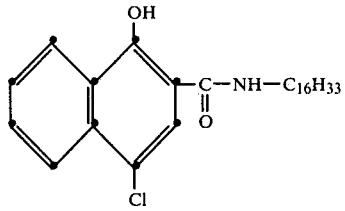 |
| F 2 | 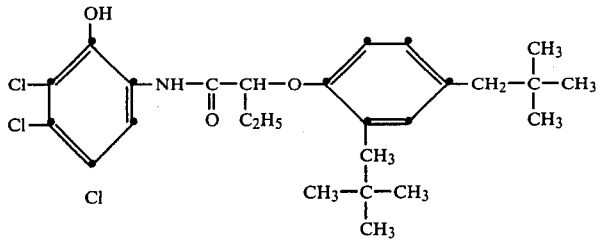 |
| F 3 | 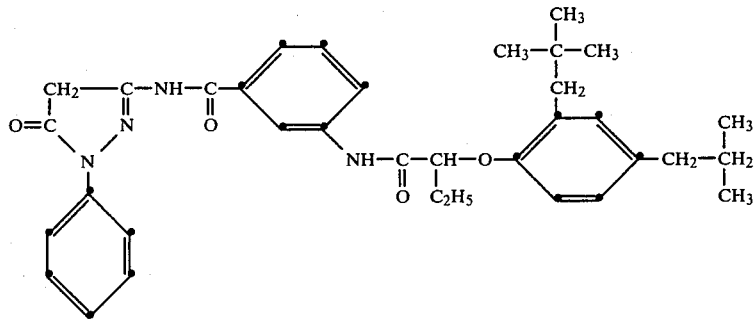 |
| F 4 | 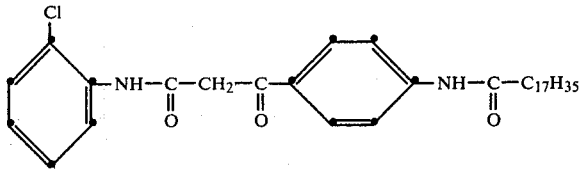 |

EXAMPLE 1

10 g of the blue-green couplers (F 1, F2) are dissolved in a mixture of 24 ml ethyl acetate and 5 ml dibutyl phthalate at 70° C. The organic solution is mixed at 60°

C. with 87 ml of an 11% gelatin solution and the auxiliary dispersing agents of Table 1, being dispersed by means of a dispersing device. The ethyl acetate is removed under reduced pressure. The dispersants obtained are solidified and stored at 5° C. The dispersing agents are characterized by means of electron microscopic photographs and determination of their transmission by spectral photometer (Table 3).

EXAMPLE 2

The dye couplers F 3 and F 4 are dispersed by an analogous method. The results have been compiled in Table 3.

EXAMPLE 3

A multiple-layer color material for purposes of positives is produced by applying known photographic structural components. Silver bromide-iodide emulsion with 15 mol.% silver chloride is used as a sub-coating. The gelatin content is 8.5%. A yellow coupler dispersant (F 4) is added to the unsensitized emulsion. Thereafter, the gelatinous intermediate layer is applied. The intermediate coating comprises a silver chloride emulsion with a gelatin content of 8.8%. The coupler dispersant was manufactured from F 3. After a renewed gelatinous intermediate layer, a silver chloride emulsion with a gelatin content of 8.6% is added. Coupler F 1 serves as a coupler for the coupler dispersant. Finally, a coating is applied. The auxiliary dispersing agent N 1 is used in all dispersants. No cast disturbances have been determined. The results set forth in Table 4 show that no photographic damages arise with the use of these auxiliary dispersing agents.

TABLE 3

| Dye coupler g | Auxiliary dispersing agent g | dg [μm] fresh | dg [μm] 3 month storage | Permeability [%] fresh | Permeability [%] 3 month storage |
|---|---|---|---|---|---|
| 10 $F_1$ | 1 $N_1$ | 0.11 | 0.11 | 98 | 98 |
| 10 $F_2$ | 1 $N_1$ | 0.09 | 0.10 | 98 | 98 |
| 10 $F_3$ | 1 $N_1$ | 0.14 | 0.14 | 97 | 97 |
| 10 $F_4$ | 1 $N_1$ | 0.12 | 0.12 | 97 | 97 |
| 10 $F_1$ | 1 $N_2$ | 0.13 | 0.13 | 96 | 96 |
| 10 $F_1$ | 1 $N_3$ | 0.11 | 0.11 | 98 | 98 |
| 10 $F_1$ | 1 $N_4$ | 0.12 | 0.12 | 97 | 97 |

TABLE 4

| | relative sensitivity | | | Gradation | | | $D_{min}$ | | |
|---|---|---|---|---|---|---|---|---|---|
| | A | B | C | A | B | C | A | B | C |
| Type(x) | 100 | 100 | 100 | >3.0 | >3.0 | >3.0 | 0.14 | 0.16 | 0.16 |
| Experiment according to Example 3 | 100 | 100 | 100 | >3.0 | >3.0 | >3.0 | 0.09 | 0.10 | 0.09 |
| Experiment according to Example 3, however with isobutyl-naphthalin-1-sulfonic acid (Na salt) as auxiliary dispersing agent | 97 | 96 | 97 | >3.0 | >3.0 | >3.0 | 0.10 | 0.11 | 0.10 |

(x)The type is produced in an analogous manner, however with utilization of the corresponding hydrophilic dye coupler.

We claim:

1. A process of dispersing oil-soluble photographic additives in aqueous gelatins or other hydrophilic binding agents in the presence of auxiliary dispersing agents, characterized in that dispersion is carried out in the presence of compounds of the general formula

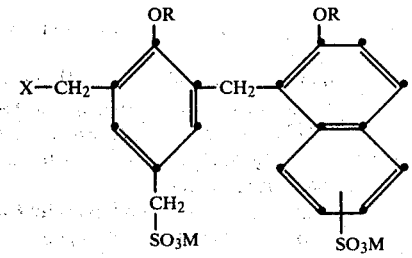

as auxiliary dispersing agents,
wherein
R represents hydrogen, alkyl with 1 to 8 C atoms,
M represents hydrogen, an alkali metal, ammonium, and
X OR or $SO_3M$.

2. A composition for dispersing oil-soluble photographic additives, comprising a dispersant of the formula

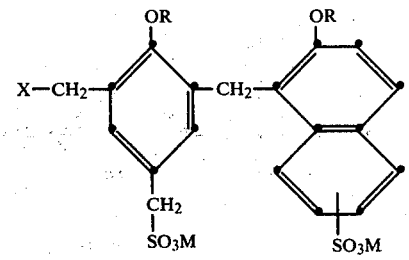

wherein
R is hydrogen, alkyl of 1 to 8 carbon atoms,
M is hydrogen, alkali metal, ammonium, and
X is OR, $SO_3M$, and/or the acceptable salts thereof.

3. The composition of claim 2 wherein R is hydrogen, M is sodium, and X is —OH.

4. The composition of claim 2 wherein R is $—CH_3$, M is sodium, and X is $—OCH_3$.

5. The composition of claim 2 wherein R is hydrogen, M is potassium, and X is —OH.

6. The composition of claim 2 wherein R is hydrogen, M is ammonium, and X is —OH.

7. The composition of claim 2 wherein said dispersant is used in an amount of 1–30% of the photographic additive.

8. The composition of claim 7 wherein said dispersant is used in an amount of 5–15% of the photographic additive.

9. The composition of claim 2 comprising the sodium salt of said dispersant.

10. The composition of claim 8 additionally comprising at least one surfactant.

11. The composition of claim 10 additionally comprising gelatin.

12. The composition of claim 2 wherein the photographic additive includes at least one additive selected from the group of dye couplers, uncolored couplers, masking compounds, dyestuffs, stabilizers, ultra-violet absorbing agents, and brighteners.

13. The composition of claim 12 wherein the dye coupler is selected from the group consisting of

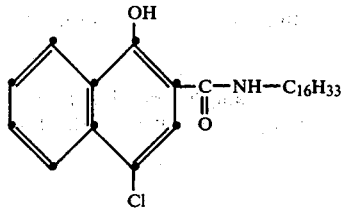

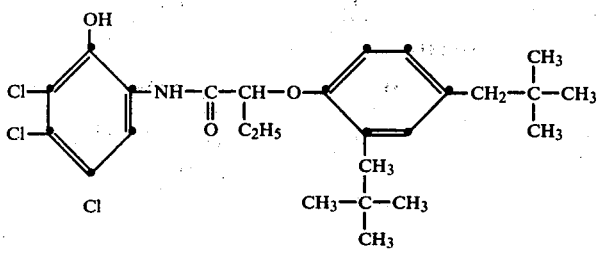

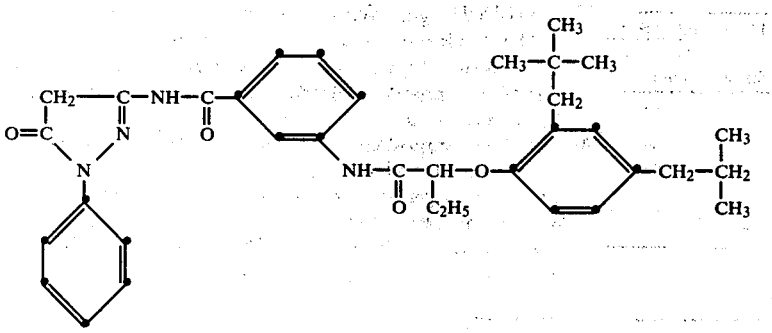

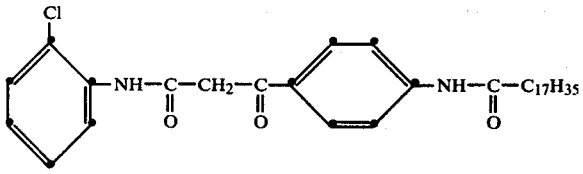

and mixtures thereof.

14. The process of claim 1 wherein R is hydrogen, M is sodium, and X is —OH.

15. The process of claim 1 wherein R is $—CH_3$, M is sodium, and X is $—OCH_3$.

16. The process of claim 1 wherein R is hydrogen, M is potassium, and X is —OH.

17. The process of claim 1 where R is hydrogen, M is ammonium, and X is —OH.

18. The process of claim 1 wherein said dispersant is used in an amount of 1–30% of the photographic additive.

19. The process of claim 18 wherein said dispersant is used in an amount of 5–15% of the photographic additive.

20. The process of claim 1 comprising the sodium salt of said dispersant.

21. The process of claim 19 additionally comprising at least one surfactant.

22. The process of claim 21 additionally comprising gelatin.

23. The process of claim 1 wherein the photographic additive includes at least one additive selected from the group of dye couplers, uncolored couplers, masking compounds, dyestuffs, stabilizers, ultra-violet absorbing agents, and brighteners.

24. The process of claim 23 wherein the dye coupler is selected from the group consisting of

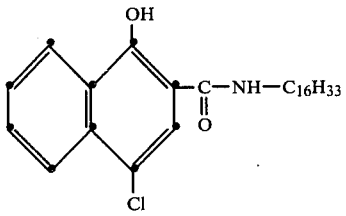
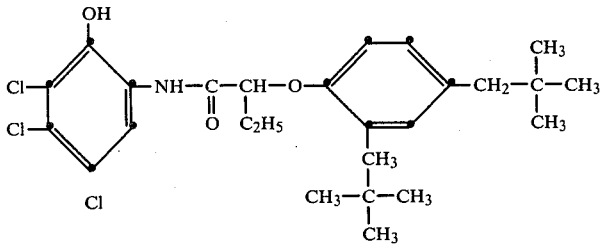
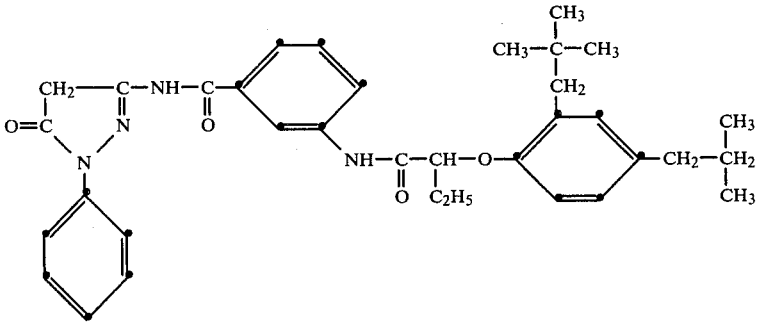
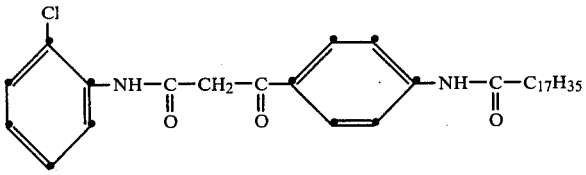
and mixtures thereof.
* * * * *